US005349770A

United States Patent [19]

Bursey et al.

[11] Patent Number: 5,349,770

[45] Date of Patent: Sep. 27, 1994

[54] FRAME DISPLAY ARRANGEMENT FOR DISPLAYING THIN, FLAT OBJECTS

[76] Inventors: Roy Bursey, 4970 Westhill Ave., Montreal, Quebec, Canada, H4V 2W5; Michel Carlos, 2828 LePailleur St., Montreal, Quebec, Canada, H1L 6G2

[21] Appl. No.: 21,306

[22] Filed: Feb. 23, 1993

[51] Int. Cl.[5] ..... G09F 1/12

[52] U.S. Cl. ..... 40/124.2; 40/159; 40/661; 206/449

[58] Field of Search ..... 40/661, 124.4, 124.2, 40/159; 206/0.84, 0.83, 38, 449, 473

[56] References Cited

U.S. PATENT DOCUMENTS

| | | | |
|---|---|---|---|
| Re. 30,959 | 6/1982 | Anderson et al. | 40/124.2 |
| 2,127,940 | 8/1938 | Rinn | 40/159 |
| 2,799,107 | 7/1957 | McArthur | 40/159 |
| 3,921,322 | 11/1975 | Sharp | 40/159 |
| 4,559,728 | 12/1985 | Price . | |
| 4,860,468 | 8/1989 | Cliborn . | |

*Primary Examiner*—Edward K. Look
*Assistant Examiner*—James A. Larson
*Attorney, Agent, or Firm*—Chilton, Alix & Van Kirk

[57] ABSTRACT

The thin, flat objects are mounted in protective encasements of a size larger than the size of the objects. A holding panel is mounted in a multi-sided frame having a plurality of cut-outs equal to the plurality of cut-outs of the holding panel, the cut-outs of the holding panel and the frame being in alignment. The encasements are mounted in the cut-outs. A restraining panel is mounted in the frame behind the holding panel. The frame is a multi-sided frame having one side which includes a removably attachable portion such that, when the removably attachable portion is removed, the panels can be slid into and out of the frame, and when the removably attachable portion is attached, the panels are maintained in the frame.

7 Claims, 3 Drawing Sheets

FRAME DISPLAY ARRANGEMENT FOR DISPLAYING THIN, FLAT OBJECTS

BACKGROUND OF INVENTION

1. Field of the Invention

The invention relates to a framed display arrangement for carrying and displaying thin, flat objects such as photographs and collector cards (e.g. baseball cards, hockey cards, etc.) or the like. More specifically, the invention relates to such an arrangement which receives the flat objects mounted in protective encasements.

2. Description of Prior Art

It is known in the art to provide frame displays as taught in, for example, U.S. Pat. No. 4,860,468, Cliborn, Aug. 29, 1989. The arrangement in the Cliborn patent consists of three panels; a front panel 12, an intermediate panel 18 and a rear panel 24. The panels have cut-outs for carrying and displaying flat objects. The cut-outs in the front panel are smaller than the objects; the cut-outs in the intermediate panel are substantially the same size as the objects, and the cut-outs in the rear panel are of greater width but lesser length than the objects. The cut-outs in the three panels are aligned. Thus, each object is mounted in the cut-out in the intermediate panel and is prevented from falling out but still exposed to display by the cut-out in the front panel. The rear panel also prevents the objects from falling out.

In accordance with the teachings of the Cliborn patent, it is contemplated that objects, such as photographs, collector cards etc., will be inserted into the arrangement and taken out of the arrangement through the cut-outs in the rear panel. However, it is believed that inserting and removing objects in this manner would cause damage to the objects by bending or otherwise mutilating them. Furthermore, the arrangement of Cliborn does not provide any protection whatsoever for the objects as the cut-outs in both the front and rear panels are uncovered.

A further display arrangement is illustrated in U.S. Pat. No. 4,559,728, Price, Dec. 24, 1985. This arrangement consists of a single panel 10 on which objects such as photographs etc. are mounted either by brackets 12 (see FIGS. 4A and 4B) or clips shown in FIGS. 6, 8, 10, 11 and 12 of the patent. Once again, the objects are unprotected.

SUMMARY OF INVENTION

It is therefore an object of the invention to provide a frame display arrangement for carrying and displaying thin, flat objects which includes means for protecting these objects.

It is a more specific object of the invention to provide such an arrangement wherein the protective means comprises encasement means.

The encasement means may comprise a transparent plastic material.

It is also an object of the invention to provide such an arrangement which includes a multi-sided frame having one side which includes a removably attachable portion.

In accordance with a particular embodiment of the invention there is provided a frame display arrangement for displaying thin, flat objects of a predetermined size, comprising:

protective encasements for protectively mounting said objects, said encasements being of a size larger than said predetermined size;

a multi-sided frame having one side which includes a removably attachable portion;

said frame having a front wall including a plurality of cut-outs, each cut-out being of a size smaller than the size of said encasements;

two panels being mounted, one behind the other, in said frame, said panels being insertable into and removable out of said frame when said removably attachable portion is removed from said frame, and being maintained in said frame when said removably attachable portion is attached to said frame;

said two panels comprising a holding panel, having a plurality of cut-outs equal to the cut-outs of said front wall of said frame and being aligned with the cut-outs of said front wall of said frame when said holding panel is mounted in said frame, the cut-outs of said holding panel being of substantially the same size as the size of said protective encasements, and a restraining panel;

said holding panel being mounted in said frame adjacent said front wall of said frame and said restraining panel being mounted in said frame adjacent said holding panel and removed from said front wall of said frame; and said encasements being mounted in the cut-outs of said holding panel;

said encasements being maintained in position within said frame by said holding panel and being prevented from falling out of said frame by said front wall of said frame and said restraining panel.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
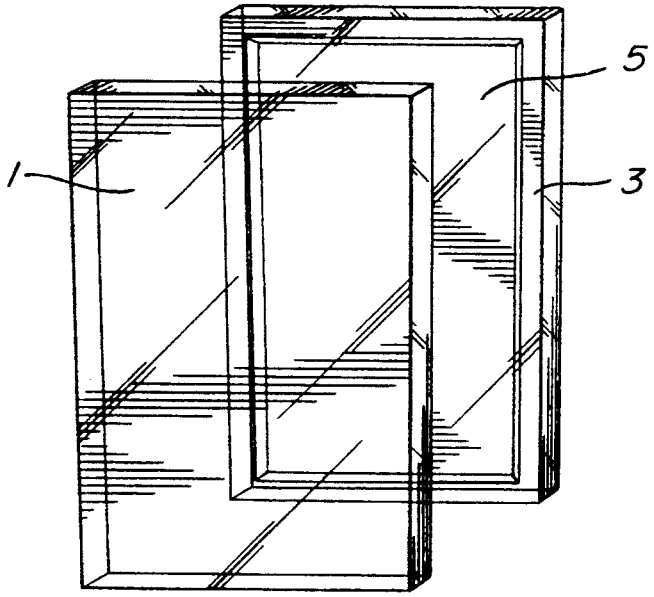
FIG. 1 illustrates one embodiment of a protective encasement.
Figure 2:
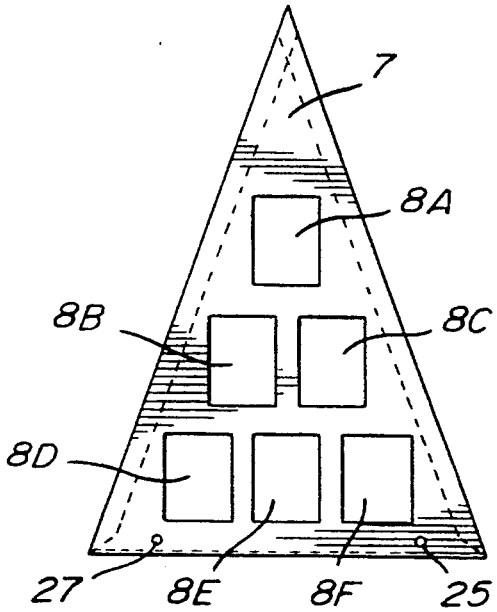
FIG. 2 is a front view of one embodiment of a frame.

Referring first to FIG. 1, an encasement for the flat thin objects, such as photographs or collector cards, comprises a first wall 1 and a second wall 3. A depression 5, as illustrated in the side of wall 3 facing wall 1, may be included in one of the walls. The depression 5 is the same size as the flat thin object. Accordingly, it is quite obvious that the size of the encasement is greater than the size of the flat thin object.

The walls 1 and 3 of the encasement will be of a transparent material. Preferably, the walls are made of a transparent plastic and are adapted to be snap-fit attached to each other. Each flat thin object, such as the photographs or collector cards, is mounted in a protective encasement between the two walls and preferably in a depression 5 in one of the walls.

Referring now to FIGS. 2 to 7, a frame in accordance with the present invention includes a front wall 7 having cut-outs 8A to 8F. The frame illustrated in FIGS. 2 to 7 is a three-sided frame. It is contemplated, in accordance with the invention, to use a multi-sided frame which could be three-sided, as illustrated, or four-sided, for example in the shape of a rectangle, or any other shape as appropriate.

Figure 4:
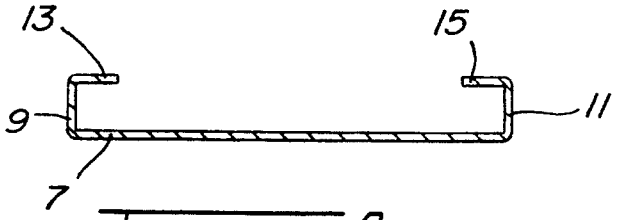
FIG. 4 is a section through IV—IV of FIG. 3.
Figure 5:
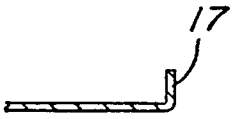
FIG. 5 is a section through V—V of FIG. 3.

As best seen in FIG. 4, the frame also includes side walls 9 and 11 and flanges 13 and 15 extending inwardly from side walls 9 and 11 respectively and at right angles to the side walls. As seen in FIG. 5, the bottom, or loading, side does not include side walls and flanges as the other two sides. Instead, it includes a lip 17.

Figure 6:
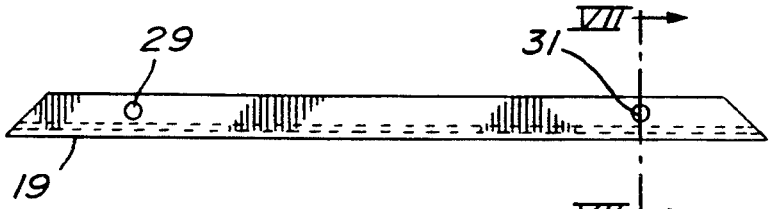
FIG. 6 illustrates the removably attachable portion of the frame.
Figure 7:
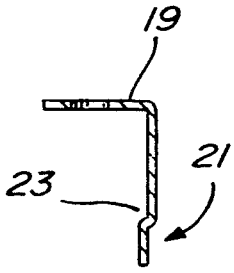
FIG. 7 is a cross-section through VII—VII of FIG. 6.
Figure 8:
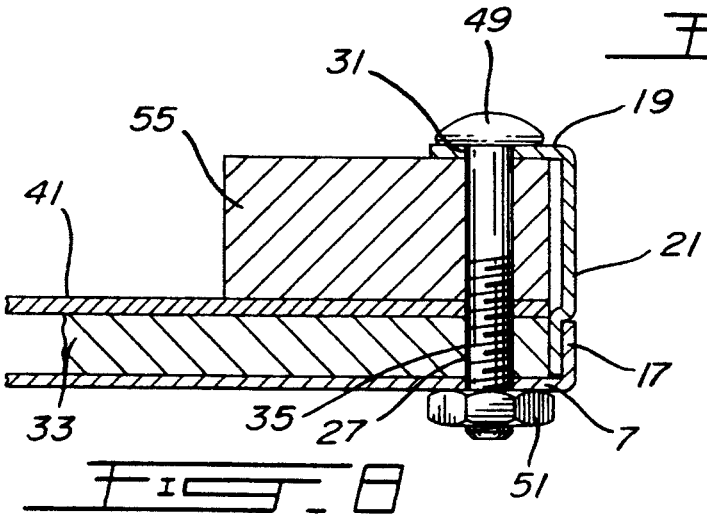
FIG. 8 illustrates one approach to attaching the removably attachable portion of the frame to the remainder of the frame.

Referring to FIG. 6, there is illustrated the removably attachable portion 19 which, as seen in FIG. 7, includes a subtending wall 21 having a kink 23. When the removably attachable portion 19 is attached to the remainder of the frame, the relationship between the lip 17 and the subtending wall 21 is as illustrated in FIG. 8, i.e., the subtending wall 21 underlies the lip 17.

Figure 3:
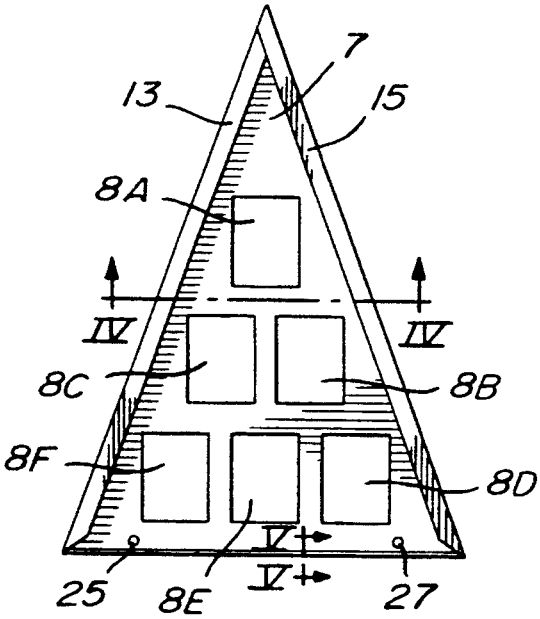
FIG. 3 is a rear view of FIG. 2.

The front wall 7 of the frame includes screw holes 25 and 27, seen in FIG. 3, and the removably attachable portion 19 includes screw holes 29 and 31 as seen in FIG. 6. Screw holes 29 and 31 are aligned, respectively, with screw holes 25 and 27 when portion 19 is mounted on the frame.

Figure 9:
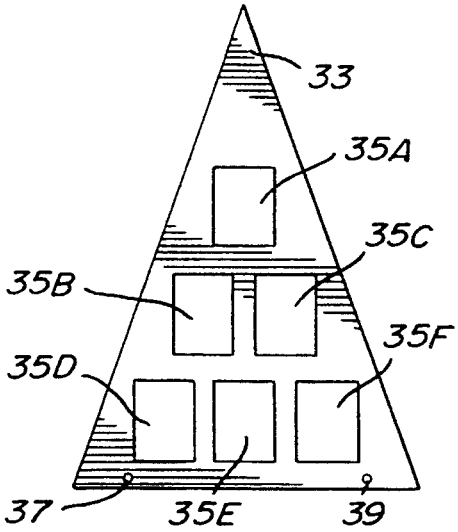
FIG. 9 illustrates a holding panel of the arrangement.

Turning now to FIG. 9, there is illustrated a holding panel 33 having cut-outs 35A to 35F. As will be seen below, cut-outs 35A to 35F are aligned, respectively, with cut-outs 8A to 8F in front wall 7 of the frame when panel 33 is mounted in the frame. The holding panel includes screw holes 37 and 39 which are aligned, respectively, with screw holes 25 and 27 and screw holes 29 and 31 when panel 33 is mounted in the frame.

Figure 10:
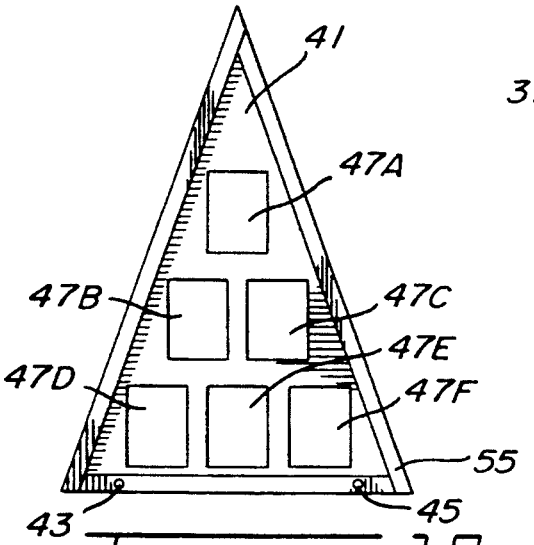
FIG. 10 illustrates a restraining panel of the arrangement.

A restraining panel 41 is illustrated in FIG. 10. The screw holes 43 and 45 of panel 41 are aligned, respectively, with screw holes 25 and 27 of the front face of the frame and screw holes 37 and 39 of the holding panel when panel 41 is mounted in the frame. In the cases when the arrangement is used to mount photographs, the restraining panel could be a solid member. When the arrangement is being used to hold collector cards, the restraining panel 41 will include cut-outs 47A to 47F which are aligned, respectively, with cut-outs 35A to 35F of holding panel 33 and cut-outs 8A to 8F of the front wall 7 of the frame when panel 41 is mounted in the frame.

The cut-outs 8A to 8F are of a size smaller than the size of the encasement illustrated in FIG. 1. The size of the cut-outs 35A to 35F are of substantially the same size as the size of the encasements. When the restraining panel 41 includes cut-outs 47A to 47F, these cut-outs will be of a size which is smaller than the size of the encasement.

Figure 11:
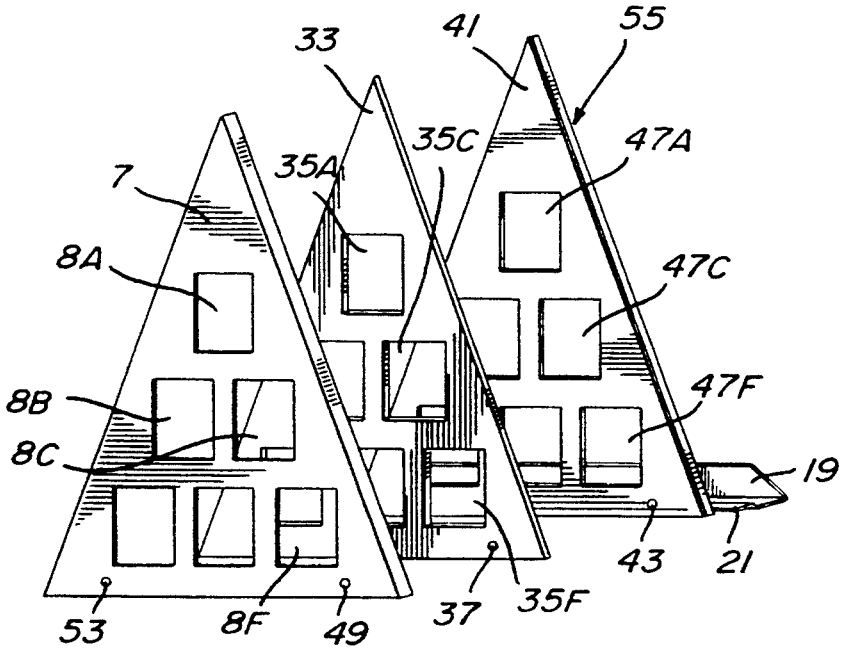
FIG. 11 is an exploded view of the assembled arrangement.

An exploded view of the arrangement is illustrated in FIG. 11. In order to ensure a tight fit, an edge trim 55, shown in FIGS. 10 and 11, could be disposed around the edge of the restraining panel 41.

In operation, each photograph or collector card to be displayed in the arrangement is mounted in an encasement as illustrated in FIG. 1. The holding panel 33 is then slid into the frame and dropped down so that the lip 17 of the frame abuts the bottom edge of the panel 33. Panel 33 does not have to be removed again for loading or unloading of cards or photographs.

The encasements are then placed into the holding panel 33 in respective cut-outs 35A to 35F. The restraining panel 41 is then slid into the frame over the holding panel 33. The removably attachable portion 19 is then mounted at the back of the frame, and screws 53 and 49 are mounted to extend through screw holes 25, 37, 43, 29 and 27, 39, 45, 31 respectively. The screws can then be screwed into nuts for example nut 51 illustrated in FIG. 8.

With this arrangement, each flat thin object, such as a photograph or collector card, is mounted in an encasement for protection against the environment and against bending or other mutilation. In addition, photographs or collector cards can be easily replaced by disassembling the arrangement and removing those cards or photographs which are to be replaced and replacing them with other cards or photographs similarly mounted in an encasement.

Although a particular embodiment has been described, this was for the purpose of illustrating, but not limiting, the invention. Various modifications, which will come readily to the mind of one skilled in the art, are within the scope of the invention as defined in the appended claims.

We claim:

1. A frame display arrangement for displaying thin, flat objects of a predetermined size, comprising:

protective encasements for protectively mounting said objects, said encasements being of a size larger than said predetermined size;

a multi-sided frame having one side which includes a removably attachable portion;

said frame having a front wall including a plurality of cut-outs, each cut-out being of a size smaller than the size of said encasements;

two panels being mounted, one behind the other, in said frame, said panels being insertable into and removable out of said frame when said removably attachable portion is removed from said frame, and being maintained in said frame when said removably attachable portion is attached to said frame;

said two panels comprising a holding panel, having a plurality of cut-outs equal in number to the cut-outs of said front wall of said frame and being aligned with the cut-outs of said front wall of said frame when said holding panel is mounted in said frame, the cut-outs of said holding panel being of substantially the same size as the size of said protective encasements, and a restraining panel;

said holding panel being mounted in said frame adjacent said front wall of said frame and said restraining panel being mounted in said frame adjacent said holding panel and removed from said front wall of said frame; and said encasements being mounted in the cut-outs of said holding panel;

said encasements being maintained in position within said frame by said holding panel and being prevented from falling out of said frame by said front wall of said frame and said restraining panel.

2. An arrangement as defined in claim 1 wherein said front wall, said holding panel and said restraining panel and said removably attachable portion have screw holes which are aligned with each other when said panels are mounted in said frame and said removably attachable portion is attached to said frame;

screws extending through said screw holes for maintaining said holding panel, said restraining panel and said removably attachable portion maintained in alignment to said frame.

3. An arrangement as defined in claim 2 wherein each side of said frame, except said one side, has a side wall extending at right angles to said front wall;

each of said side walls having a flange extending inwardly and at right angles to said side wall.

4. An arrangement as defined in claim 3 wherein said restraining panel includes an edge trim extending around the edges of said restraining panel.

5. An arrangement as defined in claim 2 wherein said restraining panel has a plurality of cut-outs equal in number to the plurality of cut-outs in said front wall and being aligned with the plurality of cut-outs in said front wall when said restraining panel is mounted in said frame.

6. An arrangement as defined in claim 3 wherein said restraining panel has a plurality of cut-outs equal in number to the cut-outs in said front wall, the cut-outs in said front wall being aligned with the cut-outs in said restraining panel when said restraining panel is mounted in said frame.

7. An arrangement as defined in claim 4 wherein said restraining panel has a plurality of cut-outs equal in number to the cut-outs in said front wall, the cut-outs in said front wall being aligned with the cut-outs in said restraining panel when said restraining panel is mounted in said frame.

* * * * *